US005114373A

United States Patent [19]

Peckman

[11] Patent Number: 5,114,373

[45] Date of Patent: May 19, 1992

[54] METHOD FOR OPTIMIZING PHOTO CATHODE PHOTO-RESPONSE

[75] Inventor: Robert Peckman, Roanoke, Va.

[73] Assignee: ITT Corporation, New York, N.Y.

[21] Appl. No.: 653,690

[22] Filed: Feb. 11, 1991

[51] Int. Cl.[5] ..... H01J 9/42; H01J 9/02

[52] U.S. Cl. ..... 445/3; 445/6; 445/13; 445/17

[58] Field of Search ..... 445/6, 3, 13, 17

[56] References Cited

U.S. PATENT DOCUMENTS 1,860,187 5/1932 Koller ..... 445/13
4,708,677 11/1967 Blank et al. ..... 445/3
4,999,211 3/1991 Duggan ..... 427/8

FOREIGN PATENT DOCUMENTS 0537408 11/1976 U.S.S.R. ..... 445/6

*Primary Examiner*—Kurt Rowan
*Assistant Examiner*—Jeffrey T. Knapp
*Attorney, Agent, or Firm*—Arthur L. Plevy; Patrick M. Hogan

[57] ABSTRACT

A method for optimizing the photo-response of a photocathode having a gallium-arsenide layer and a cesium-oxide surface coating includes the steps of overcesiating the photocathode, sealing it in a vacuum tube and baking the assembly in an oven. The photo-response of the photocathode is measured while it is baked, such measurements comprising an input to a microprocessor which controls the baking process by varying the temperature and/or time of baking. The rate of increase of photo-response due to heating and optimizing the photo-response attributable to the cesium-oxide coating is determined by utilizing a formula which relates temperature and photo-response and permits room temperature photo-response to be projected from a measurement taken during the baking process. When the rate of increase shows a characteristic diminishing pattern, the photo-response has been maximized and the baking is terminated.

20 Claims, 3 Drawing Sheets

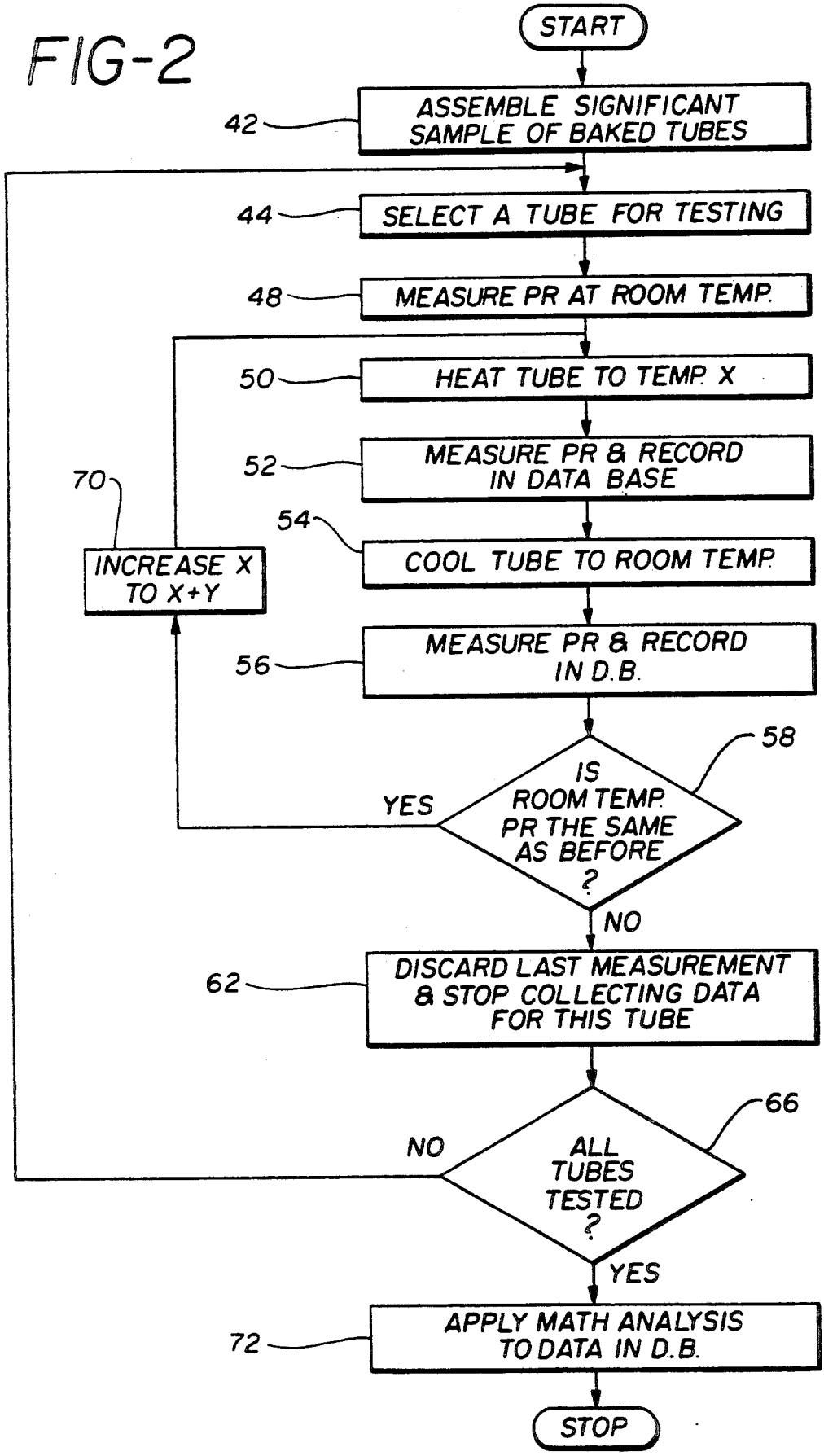
FIG-2
START
42
ASSEMBLE SIGNIFICANT SAMPLE OF BAKED TUBES
44
SELECT A TUBE FOR TESTING
48
MEASURE PR AT ROOM TEMP.
50
HEAT TUBE TO TEMP. X
52
MEASURE PR & RECORD IN DATA BASE
54
COOL TUBE TO ROOM TEMP.
70
INCREASE X TO X+Y
56
MEASURE PR & RECORD IN D.B.
58
IS ROOM TEMP. PR THE SAME AS BEFORE ?
YES
NO
62
DISCARD LAST MEASUREMENT & STOP COLLECTING DATA FOR THIS TUBE
66
ALL TUBES TESTED ?
NO
YES
72
APPLY MATH ANALYSIS TO DATA IN D.B.
STOP

METHOD FOR OPTIMIZING PHOTO CATHODE PHOTO-RESPONSE

BACKGROUND OF THE INVENTION

1. Field of the Invention

The present invention relates to a method of manufacturing photocathodes for use in photosensitive vacuum tubes, and more particularly, to a method for optimizing a photocathode's photo-response by means of a baking process.

2. Description of the Prior Art

It has previously been discovered that a layer of gallium arsenide (GaAs) deposited upon a photon transparent substrate and surface treated by a layer of cesium oxide forms an effective photocathode. Photocathodes of this type are utilized in image intensifiers, such as, those which are employed in night vision devices. In such intensifiers, the photocathode is typically deposited upon the inner surface of an input window which is vacuum sealed within a tube envelope. Electrons generated in the photocathode in response to an input of photons are accelerated and/or amplified by subsequent tube components to generate an intensified output image. For a photocathode to generate a photocurrent, i.e., a flow of electrons, in response to photon input, three things must take place. First, photons photon input, three things must take place. First, photons must be captured in the bulk material, e.g., GaAs, causing a release of electrons within the bulk material. Second, the released electrons must reach the surface of the bulk material before being reabsorbed. Lastly, the electrons must escape the attractive forces of the surface of the bulk material and proceed to the next component of the tube. It has been found that a cesium-oxide treatment of the surface of a GaAs layer reduces the attractive force on the photoelectrons in question so that a large portion of them escape, resulting in a large photo-response (PR). The amount of energy needed by an electron to leave the surface of a photocathode is called the work function. GaAs photocathodes that are properly activated with cesium-oxide actually have a negative work function and repel electrons from the surface into the tube. Imperfections in the cesium oxide surface treatment, such as molecules with the wrong stoichiometry, however, are attractive sites to the electrons and the regions immediately surrounding them have no PR, thereby reducing the overall PR of the device.

The cesium-oxide layer is typically deposited on the cathode surface by a vacuum deposition process. It has been found that the best photo-response results are achieved by monitoring the PR during the deposition process. In this manner, the process is terminated when the best compromise is achieved between maximizing the PR and incurring an excessive detrimental dark current. The deposition process is terminated when the PR is at its maximum level, however, the oxygen and cesium in the environment cannot be eliminated the instant maximum PR is sensed. Cesium, in particular, remains in the deposition environment longer and in greater quantity than oxygen. This causes excess cesium to be deposited on the surface of the photocathode, upsets the stoichiometry and degrades the PR. By the time the photocathode is sealed into the tube, the PR is less than 1/10 its previously observed maximum value. There are known processes, however, to restore the lost PR by baking the tube in an oven. It is also commonly accepted that baking an over-cesiated photocathode results in a photocathode having the most stable PR. Therefore, rather than avoiding over-cesiation, the standard practice in the industry is to over-cesiate the photocathode in the vacuum system and then subject the sealed tube to a baking process to restore the PR. It is the surface layer of cesium-oxide that is improved by the baking process rather than the GaAs layer.

The details of the physics of what happens during the PR bake process is not well understood, but it has been observed that the PR increases during the baking process, reaches a maximum, and then degrades if the process is continued. The PR lost by over-baking a tube is not recoverable. Tubes that are baked up to, but do not pass, their maximum PR also have maximum stability, i.e., the photo-response tends not to change during use. It is, therefore, important to sense when the PR is maximized and to stop baking at that time. Unfortunately, because the contribution to photo-response of the bulk material, e.g., GaAs, is adversely (but reversibly) affected by heating, the peak photo-response level of the surface layer can not be sensed merely by monitoring the photo-response of the tube during heating. The primary effect of heating on the bulk material is to make the electrons which are generated by the photon input reabsorb more readily before they can reach the surface to leave the photocathode. While the component of PR which is due to the cesium-oxide surface is maximized through baking, the bulk material component is diminished during the baking process. The PR measured during baking includes both the surface component and the diminished bulk material component. The adverse effects of the heat of baking on the PR of the bulk material layer reverse upon cooling, however, and the baking process does not permanently diminish the PR component attributable to the bulk material layer.

The rate at which the surface component of the PR increases as it is baked is controlled by the baking temperature and the proximity to maximized PR. The higher the baking temperature, the faster the increase in PR. The closer to the maximum achievable PR, the slower the increase. The rate of increase in surface component PR also depends upon the individual cathode.

There are presently two standard procedures for baking photocathodes to maximize PR. The first procedure is to bake the tube for a set period of time, e.g., one hour; let it cool to room temperature; and then measure the PR. This cycle is repeated over and over and the increase in PR is measured during each cycle. The bake temperature of each cycle is selected to keep the rate of increase in the desired range. When the rate of increase approaches zero, the baking process is terminated, this being an indication that maximum PR has been realized. There are certain disadvantages with this process, viz., each warming/cooling cycle consumes a great deal of time; there is a lack of control of the cool temperature which introduces error; and the warming and cooling times impose a practical limit both on the shortness of the bake time of each cycle and on the accuracy of finish time. The long time period between measurements also limits the number and resolution of the temperature increments. If the increments are infrequent, they must be large in order to arrive at the desired temperature.

Another common alternative is to bake the tube at a constant temperature. In this way, the PR can be measured at the bake temperature because the component of the PR which is affected by the temperature is held constant and only the component due to the surface layer is varying. This permits frequent measurements so the process can be stopped at the moment of peak PR. The disadvantage with this method is that there is no control of the rate of this process, i.e., by increasing the baking temperature. Also, because some tubes require higher than normal temperatures to bake properly, they cannot be maximized by this method.

It is therefore an object of the present invention to provide a method for baking a photocathode interactively varying the temperature of baking in response to measured PR.

It is a further object to provide a method for measuring PR while baking a photocathode that isolates the component of PR attributable to the surface layer from that of the bulk material, or, in other words, project the room temperature PR given a PR measurement while the cathode is being baked.

SUMMARY OF THE INVENTION

The problems and disadvantages associated with the conventional techniques and devices utilized to optimize the photo-response of a photocathode having a gallium-arsenide layer and a cesium-oxide surface coating are overcome by the present inventive method which includes measuring the photo-response of the photocathode while it is being heated. The rate of increase of photo-response due to the heating is ascertained and the temperature of heating is adjusted accordingly to shorten the duration of heating required to substantially optimize the photo-response of the photocathode.

BRIEF DESCRIPTION OF THE FIGURES

For a better understanding of the present invention, reference is made to the following detailed description of an exemplary embodiment considered in conjunction with the accompanying drawings, in which:

FIG. 2 is a flowchart illustrating a sequence of steps for determining the temperature correction function.

DETAILED DESCRIPTION OF THE FIGURES

Figure 1:
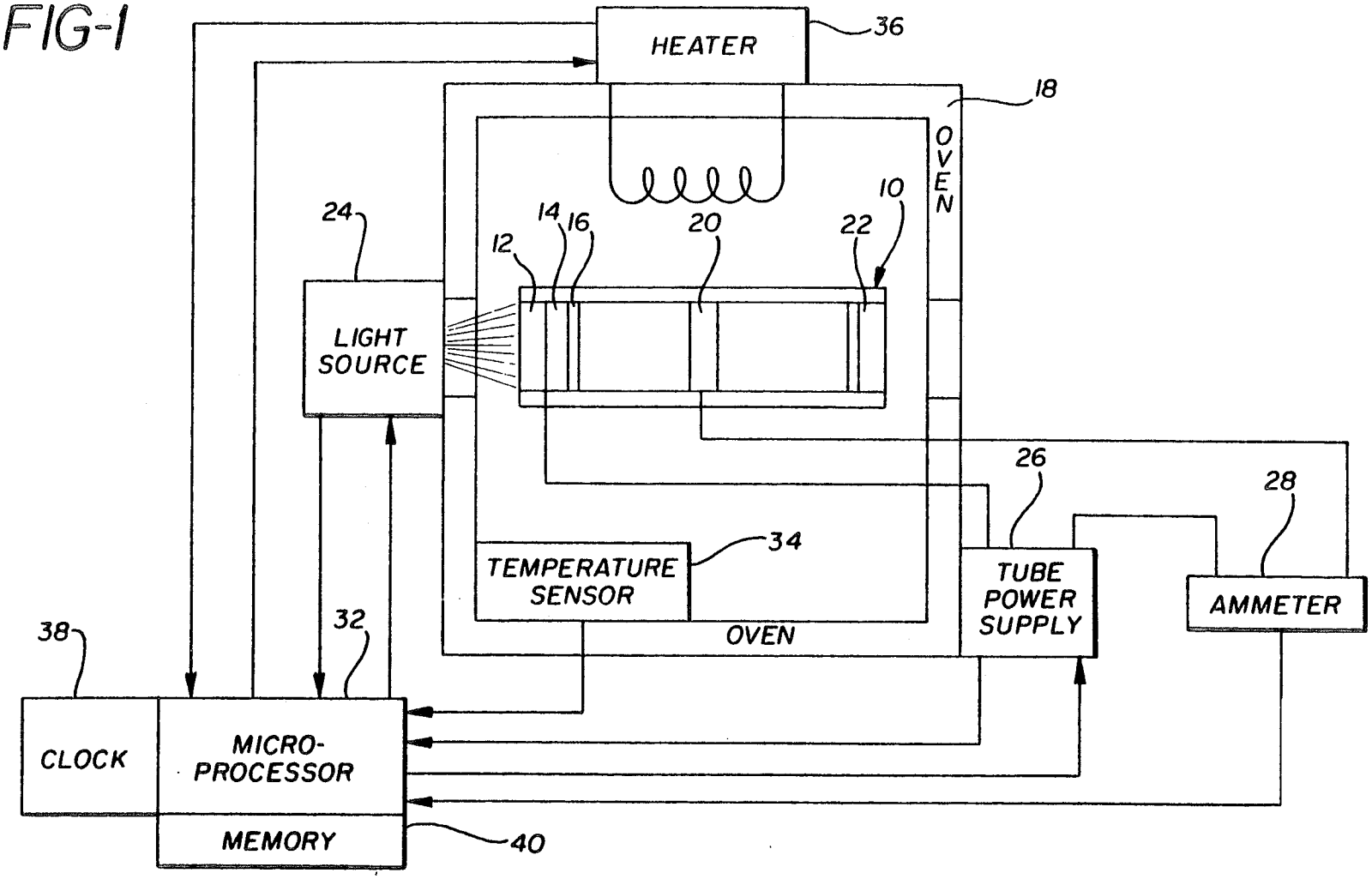
FIG. 1 is a diagram depicting apparatus for carrying out an exemplary embodiment of the present inventive method.

FIG. 1 illustrates in diagrammatic form an apparatus for implementing the present inventive method. An image intensifier tube 10 having an input window 12 upon which is deposited a photocathode bulk material layer of gallium arsenide (GaAs) 14 surface coated with a layer of cesium oxide 16 is shown positioned within an oven 18. The image intensifier tube further includes a microchannel plate 20 and a phosphor coated fiber optic output window 22. Upon being irradiated with light from light source 24 the tube generates a photocurrent as follows. The light photons pass through the input window 12 and enter the GaAs layer 14 wherein they dislodge electrons via the photoelectric effect. The dislodged electrons migrate through the GaAs layer under the influence of an applied electrostatic field which induces them to move in the direction of the microchannel plate 20. The dislodged electrons encounter the surface coating of cesium-oxide which facilitates their departure from the photocathode due to the negative work function associated with cesium-oxide and toward the microchannel plate 20 which is separated from the photocathode (14 and 16) by a vacuum gap. In normal operation, the microchannel 20 plate amplifies the electron flow emitted from the photocathode (14 and 16) and the output of the microchannel plate 20 is accelerated toward the phosphor coating on the output window 22 by another electrostatic field. Upon striking the phosphor coating, the amplified and accelerated electron flow is reconverted into visible light which is projected out the fiber optic output window 22. During implementation of the present inventive method, however, only the photocurrent is created and measured. Screen voltages for amplifying or accelerating the photocurrent are not, therefore, applied during the photoresponse maximizing process, as shall be described at length below. The above-described type of image intensifier is known in the art and the details of its construction and operation are included for illustration only. Other tube types using a GaAs/cesium-oxide photocathode could be PR maximized in accordance with the present inventive method.

In accordance with the present method, a photocathode (14 and 16) is, prior to baking, over-cesiated due to the limitations of the vacuum deposition process as described above. The tube 10 is vacuum sealed and, as such, is operative as a light intensifier, albeit having a degraded photo-response (PR) due to over-cesiation (improper stoichiometry). The tube 10 is positioned within an oven 18 to receive light from a light source 24 which is shown outside the oven 18 and projecting through a transparent portion thereof such as a heat resistant glass window. Alternatively, the light source could be located within the oven 18. The tube 10 is energized by a power supply 26 which provides the necessary voltage to draw elections from the photocathode to the microchannel plate 20. An ammeter 28 is connected to the power supply 26 to sense the tube photocurrent dependent upon the PR. The output of the ammeter 28 is directed to a microprocessor 32 which receives these readings as inputs for controlling the baking process as more fully described below. The microprocessor 32 also receives sensory input from a temperature sensor 34 positioned within the oven 18, and has outputs for controlling the oven heater 36, and the light source 24, each of these elements also having a status indicator input to the microprocessor 32. To facilitate the microprocessor's control function, it is equipped with a clock 38 for timing processes and with a memory 40 for storing sensed values, as well as, a memory for storing programmed information. Although a clock and memory might well be incorporated into standard microprocessors, same are mentioned explicitly for the sake of completeness.

The present inventive process pertaining to a method of baking a photocathode at a rate and temperature determined by measuring the resultant PR during the baking process to maximize the PR attributable to the cesium-oxide surface layer is dependent upon a preliminary determination of the relationship between the surface PR component, the bulk layer PR component, and the temperature. As has been stated previously, the bulk material (GaAs) exhibits a decreased PR as the temperature rises. This decrease in PR masks the increase in PR attributable to the surface layer due to baking and thus has previously prevented the simultaneous monitoring of PR while the photocathode is being baked to be used as a guide for adjusting the baking temperature and time. It should also be recalled that the surface layer increase in PR upon heating is limited, by the over-bake limit, beyond which the PR declines.

The aforementioned relationship and the negative bulk material PR effect due to heating has been identified and quantified through the method as shown in the flow chart of FIG. 2. The reference numerals employed in the description of FIG. 2 and FIG. 3 refer to the modules depicted therein. In general, a data base of tube performance values over a range of temperatures for a large number of tubes was generated. The data base was then analyzed to determine the mathematical relationship between the temperature and the PR. More specifically, a large number of tubes was assembled for testing 42. To eliminate variability due to increases in the surface component due to baking, the tubes were first baked to stability using the conventional inefficient and time consuming methods. Each tube was then tested over a range of temperatures to determine the PR at those temperatures. In the data collection process, a tube was selected 44 and was measured for PR at room temperature 48. The tube was then heated to a first temperature level 50 and the PR observed and recorded in the data base 52. The tube was then cooled to room temperature 54 and the PR measured and recorded 56. If the PR remained the same for all room temperature readings subsequent to the first, then it was established that the surface coating was stable during heating 58. In the event that the room temperature PR changed upon a subsequent reading 58, that was an indication that the tube was initially unstable or had become unstable during the last heating step which invalidated that bake-temperature PR measurement. Data collection for unstable tubes was halted 62. Having gleaned a collection of PR data over a range of temperatures for a number of tubes 66 and 70, a mathematical relationship which was descriptive and consistent with the data 72 was sought using standard techniques. It was discovered that the composite PR, i.e., that due to the surface component and the bulk layer component, is lessened in relation by a factor of $1/(1+(0.005\times\text{temperature})$ due to the effect of heating on the bulk material layer. Thus, at any given temperature above room temperature, the PR at room temperature can be calculated to be [Measured PR at temperature $T\times(1+(0.005\times\text{temperature } T))$]. This relationship allows the room temperature PR to be projected from a PR measurement taken at higher baking temperatures. Using this formula eliminates the necessity to wait for the photocathode to cool to room temperature before determining the room temperature PR.

The analytical method described in reference to FIG. 2 was performed for a particular type of intensifier tube. The process, however, would be applicable to discern the relevant PR temperature relationships for other types of tubes, and it is not intended that invention herein be limited to a method suitable only for the particular tubes analyzed or to the aforementioned resultant mathematical relationship determined.

Figure 3:
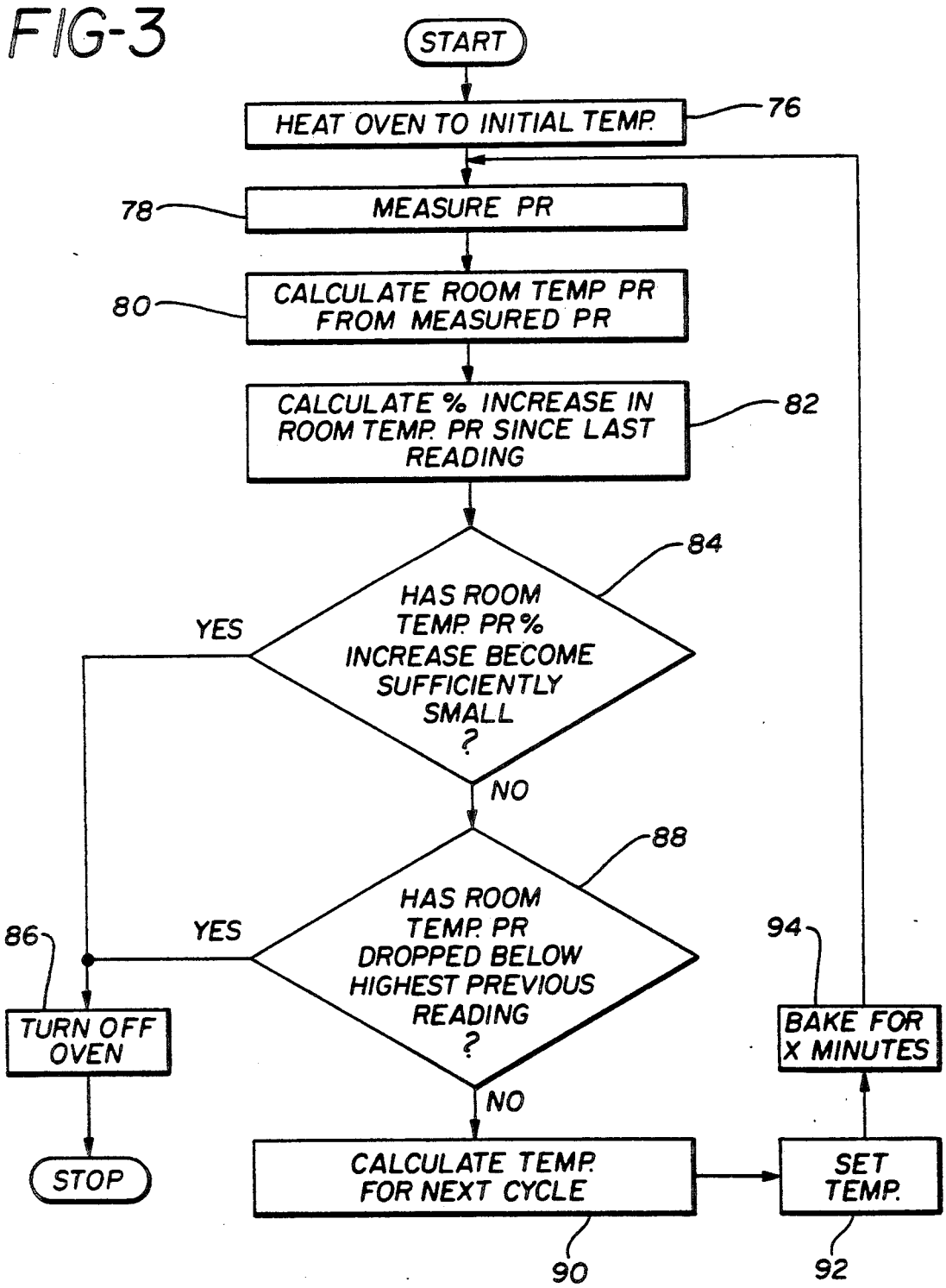
FIG. 3 is a flow chart illustrating a sequence of steps for implementing an exemplary embodiment of the present inventive method utilizing the apparatus depicted in FIG. 1.

Having established a method of quantifying the PR loss due to heating of the bulk layer over a range of temperatures and, correspondingly, the actual PR increase attributable to the surface layer, the present inventive method as charted in FIG. 3 can be performed. Assuming an apparatus similar to that shown in FIG. 1, the oven 18 is heated to an initial temperature and for a time well below that at which cathode degradation is known to occur 76. Upon the oven reaching the initial temperature, the PR of the tube is measured 78 by means of light source 24 and a sensor on the current from the photocathode to the next tube element. A projected room temperature PR is then calculated based upon the aforementioned relationship 80. The percentage increase in PR is calculated using the previous PR reading and the current PR reading 82. If the PR increase is determined to be sufficiently small it indicates that the PR is approaching the maximum value and the oven can and must be turned off prior to overbaking. The PR exhibits small increases in two circumstances, however, viz., when the baking temperature is not high enough to generate a large increase, and when the PR is approaching maximum value. The present method differentiates between these two situations by increasing the temperature as the increases become small. When the PR increase approaches zero, it does so while the temperature is increasing. Therefore the smallness of the increases are due to the maximum point being reached and the baking is halted 86. Sometimes measurement errors mask the approach of the PR increase rate to zero. Therefore, prior to recalculating the temperature of the next bake cycle, the current projected room temperature PR is checked to determine if it has dropped below the highest previous reading 88, if so, the tube has been overbaked and the baking is terminated 86.

Assuming that the photocathode has not yet been maximized 84, nor overbaked 88, the temperature for the next baking cycle is calculated 90. Generally, the new temperature is set higher when smaller increases in PR have been observed and left alone when greater increases in PR have been realized. For example, if the PR increase is observed to be greater than 1%, then the temperature is not increased, if it is between ½% and 1%, the temperature is increased 1 degree C., and if it is less than ½%, the temperature is increased by 2 degrees C. for the next baking cycle. Once the temperature for the next cycle is calculated, the temperature is set 92 and the tube is baked for additional time, e.g., seven minutes, whereupon the testing/heating cycle is begun again.

It should be appreciated that the present method provides a method for accurately and quickly baking cesium-oxide surface treated GaAs photocathodes to a state of maximum PR without overbaking.

It should be understood that the embodiments described herein are merely exemplary and that a person skilled in the art may make many variations and modifications without departing from the spirit and scope of the invention as defined in the appended claims.

I/We claim:

1. A method for optimizing the photo-response of a photocathode having a gallium-arsenide layer and a cesium-oxide surface coating comprising the steps of:

(a) heating said photocathode;

(b) measuring the photo-response of said photocathode during said step of heating;

(c) ascertaining the rate of increase of photo-response due to aid step of heating; and (d) adjusting the temperature at which said step of heating occurs to shorten the duration of said step of heating required to substantially optimize the photo-response of said photocathode.

2. The method of claim 1, wherein said steps (a), (b), (c) and (d) are repeated until the photo-response of said photocathode is substantially optimized.

3. The method of claim 2, further including the steps of overcesiating said photocathode relative to oxygen and sealing said overcesiated photocathode within a substantially evacuated tube prior to said step of heating.

4. The method of claim 3, wherein said step of ascertaining includes calculating the room temperature photo-response based upon the measured photo-response during heating.

5. The method of claim 4, wherein said step of ascertaining, after having been repeated at least once, includes comparing the rate of increase of room temperature photo-response with prior rates of increase to determine if there is a shrinking rate of increase indicative of optimization of photo-response.

6. The method of claim 5, wherein the magnitude of adjustment in said step of adjusting is dependent upon the rate of photo-response increase determined during said step of ascertaining.

7. The method of claim 6, wherein said step of heating is by baking in an oven.

8. The method of claim 7, wherein said step of adjusting includes terminating said baking by turning said oven off when the photo-response of said photocathode is substantially optimized.

9. The method of claim 4, wherein said step of calculating uses a formula describing the relationship between the temperature and the photo-response of said photocathode derived by performing the following steps:

(m) assembling a sample set of similar photocathodes;
(n) observing the photo-response of said similar photocathodes at a range of temperatures;
(o) recording the temperature/photo-response data observed in the prior step; and
(p) mathematically analyzing said recorded data to determine said formula describing the relationship between temperature and the photo-response of said photocathode.

10. The method of claim 9, further including the steps of baking each of said photocathodes of said sample set to a condition of substantially maximum photo-response prior to said step of observing.

11. The method of claim 10, wherein said step of observing includes observing the photo-response of said similar photocathodes at room temperature; heating said photocathodes to an incrementally increasing temperature within said range; observing the photo-response of said photocathodes at said increased temperatures; allowing said photocathodes to cool to room temperature and observing the photo-response at room temperature between each incremental increase in temperature; comparing subsequent observed room temperature photo-response to prior observed room temperature photo-response to determine if the subsequent observed photo-response at room temperature is different than the prior observed photo-response at room temperature; discarding observed photo-response data collected at the last said increased temperature upon a determination that a subsequently observed room temperature photo-response is different from a previously observed room temperature photo-response.

12. The method of claim 11, wherein the upper limit of said range of temperatures is less than the temperature after which room temperature photo-response is changed by further baking.

13. The method of claim 4, wherein said room temperature photo-response is calculated substantially according to the formula: Room temperature photo-response = Measured photo-response at temperature T * (1 + (1/0.005 * temperature T)).

14. The method of claim 6, further including the steps of initially heating said photocathode and initially measuring the photo-response of said photocathode upon reaching the temperature at which said initial heating takes place, prior to the performance of repeated steps (a) through (d).

15. The method of claim 6, wherein each of said steps are controlled by a microprocessor.

16. The method of claim 6, wherein said step of measuring photo-response is performed by a photo-current sensor.

17. The method of claim 6, further including the step of adjusting heating time simultaneous with said step of adjusting heating temperature.

18. The method of claim 17, wherein during said step of adjusting, said temperature is adjusted upward approximately 2 degrees C. if the photo-response increase is less than approximately 0.5%, approximately 1 degree C. if the photo-response increase is less than approximately 1%, and is not increased if the photo-response increase is greater than approximately 1%.

19. A method for optimizing the photo-response of a photocathode having a gallium-arsenide layer and a cesium-oxide surface coating comprising the steps of:

(a) heating said photocathode;
(b) measuring the photo-response of said photocathode during said step of heating;
(c) ascertaining the rate of increase of photo-response due to said step of heating and calculating the room temperature photo-response based on the measured photo-response during heating; and
(d) adjusting the temperature at which said step of heating occurs to shorten the duration of said step of heating required to substantially optimize the photo-response of said photocathode.

20. The method of claim 18, 19 wherein said step of calculating uses a formula describing the relationship between the temperature and the photo-response of said photocathode derived by performing the following steps:

(e) assembling a sample set of similar photocathodes;
(f) observing the photo-response of said similar photocathodes at a range of temperatures;
(g) recording the temperature/photo-response data observed in the prior step; and
(h) mathematically analyzing said recorded data to determine said formula describing the relationship between temperature and the photo-response of said photocathode.

* * * * *